US009200446B1

(12) United States Patent
diGirolamo et al.

(10) Patent No.: US 9,200,446 B1
(45) Date of Patent: Dec. 1, 2015

(54) BRIDGING MEMBER

(75) Inventors: Edward R. diGirolamo, Raleigh, NC (US); Michael L. Torres, Raleigh, NC (US); Milan Dragic, Wake Forest, NC (US)

(73) Assignee: The Steel Network, Inc., Durham, NC (US)

( * ) Notice: Subject to any disclaimer, the term of this patent is extended or adjusted under 35 U.S.C. 154(b) by 2876 days.

(21) Appl. No.: 11/358,757

(22) Filed: Feb. 21, 2006

(51) Int. Cl.
*E04C 2/52* (2006.01)
*E04B 5/12* (2006.01)
*E04C 3/02* (2006.01)

(52) U.S. Cl.
CPC ..... *E04B 5/12* (2013.01); *E04C 2003/026* (2013.01)

(58) Field of Classification Search
CPC ..... E04B 5/12; E04C 3/02; E04C 2003/026
USPC ..... 248/216.1, 217.2, 217.3; 52/712, 696, 52/220.1, 220.8, 693, 317
See application file for complete search history.

(56) References Cited

U.S. PATENT DOCUMENTS

| | | | | | |
|---|---|---|---|---|---|
| 529,993 | A * | 11/1894 | Allen | 182/220 |
| 1,027,425 | A * | 5/1912 | Makowski | 52/696 |
| 2,103,064 | A * | 12/1937 | Clark | 52/696 |
| 3,163,386 | A * | 12/1964 | Collins | 248/71 |
| 4,122,647 | A * | 10/1978 | Kovar | 52/695 |
| 4,246,736 | A * | 1/1981 | Kovar et al. | 52/696 |
| 4,658,556 | A * | 4/1987 | Jenkins | 52/317 |
| D293,416 | S * | 12/1987 | Krueger | D8/373 |
| 5,230,190 | A * | 7/1993 | Schuette | 52/220.1 |
| 5,412,920 | A * | 5/1995 | Hess | 52/712 |
| 5,546,716 | A * | 8/1996 | Broxterman et al. | 52/220.1 |
| 5,784,850 | A | 7/1998 | Elderson | |
| 5,884,448 | A * | 3/1999 | Pellock | 52/643 |
| 5,927,036 | A * | 7/1999 | Matthews et al. | 52/483.1 |
| 6,021,618 | A | 2/2000 | Elderson | |
| 6,131,359 | A * | 10/2000 | Duff | 52/706 |
| 6,418,694 | B1 * | 7/2002 | Daudet et al. | 52/650.1 |
| 6,708,460 | B1 | 3/2004 | Elderson | |
| 6,718,698 | B1 * | 4/2004 | Thompson | 52/92.2 |
| 6,807,780 | B2 * | 10/2004 | McCahill et al. | 52/220.8 |
| 6,993,882 | B2 * | 2/2006 | Crawford et al. | 52/696 |
| 7,213,377 | B1 * | 5/2007 | Sackett | 52/696 |
| 2004/0187414 | A1 * | 9/2004 | Brochu | 52/272 |
| 2004/0200172 | A1 * | 10/2004 | Beck et al. | 52/506.03 |
| 2006/0016139 | A1 * | 1/2006 | Beck et al. | 52/289 |
| 2007/0193193 | A1 * | 8/2007 | Lewis | 52/702 |

* cited by examiner

*Primary Examiner* — Brent W Herring
(74) *Attorney, Agent, or Firm* — Jenkins, Wilson & Taylor & Hunt, P.A.

(57) ABSTRACT

A bridging member for attachment between two structural members is described. The bridging member addresses the need to provide lateral bracing between wooden structural members such as joists, studs and rafters for which the depth of the members relative to the thicknesses requires bracing to avoid twisting or buckling. The bridging member includes a web and a pair of side flanges. Disposed on each end of the bridging member is an end flange that is disposed at an angle with respect to the web, and a connecting or end tab. The end flanges are adapted to be fastened or connected to opposing sides of the structural members while the end tabs are adapted to be secured to a top or bottom portion of the structural members.

3 Claims, 7 Drawing Sheets

BRIDGING MEMBER

FIELD OF THE INVENTION

The present invention relates to a device and methods for effecting bridging between generally parallel structural members used in building construction.

BACKGROUND OF THE INVENTION

In building construction, generally parallel structural members such as joists in floors and ceilings, studs in walls, and rafters in roofs carry and transmit loads by spanning between support structures. These structural members are sometimes required to be laterally braced against each other by a stiffening and stabilizing member. Indeed, most local building codes require that in wood construction such structural members having depth-to-thickness ratios of 6:1 or greater must have lateral bracing installed at specified minimum intervals along the span of the structural members.

A typical method of bracing such structural members employs so-called "X-bridging." Here, structural members, for example floor joists, are placed in position and anchored to the underlying structure. Laterally-applied wooden slats are nailed to the opposing surfaces of the structural members and angled such that a slat will connect between the top edge of one structural member of a pair and the bottom edge of the succeeding one and an immediately adjacent slat will connect between the bottom edge of the first structural member and the top edge of the succeeding member thereby creating an "X" structure between them. "X-bridging" made of metal is also used. Installing either wooden or metal "X-bridging" typically requires applying fasteners by workers from above, in the case of joists for example, and from below the floor. This procedure normally requires installing the "X-bridging in one stage and completing the installing in a second stage which is often inadvertently overlooked. The spaces between the slats in the "X" configuration permit passing utilities such as plumbing and wiring between the structural members.

Another common method of bracing employs cutting and laterally placing a block or member between a pair of structural members. This method is sometimes referred to as "blocking". This method likewise typically requires fastening actions by workers located above and below, in the case of floors for example. Moreover, openings must subsequently be made in the blocking to permit passage of utilities such as plumbing and wiring where required.

SUMMARY OF THE INVENTION

This invention relates to a metal member or unit configured to form a bridging member to be used in combination with wooden or similar structural members in building construction and to methods for using the bridging member in construction. The bridging member includes a web and side flanges for structural integrity, end flanges and tabs with cleats to anchor to structural members.

In one embodiment the bridging member includes a web and a pair of side flanges. Disposed on opposite ends of the bridging member is an end flange that is disposed at an angle with respect to the web. Further disposed on each end of the bridging member is an end tab. In use, the bridging member extends between two structural members and the end flanges are secured or fastened to opposing faces of the structural members while the end tabs are secured to top or bottom portions of the structure members.

In one particular embodiment of the present invention, the end flanges are disposed at a generally 90° angle to the web and the end tabs are extensions of the end flanges and are disposed at an angle generally 90° with respect to the end flanges.

The present invention also entails a method of bridging two spaced apart structural members. This method of bridging includes extending the bridging member between the two structural members and fastening or securing the two opposing end flanges to opposing side surfaces of the structural members.

The method described above can also include securing the end tabs to upper or lower portions of the two structural members. Thus, in the case of this embodiment, the method entails fastening the end flanges and the end tabs to two different surfaces of the structural members that are disposed at an angle of generally 90°.

Other objects and advantages of the present invention will become apparent and obvious from a study of the following description and the accompanying drawings which are merely illustrative of such invention.

DESCRIPTION

The present invention relates to a device and a process for improving the reinforcing of certain structural members in wood construction. As mentioned above, structural members such as joists, rafters, and studs for which the height-to-thickness ratio for the cross section exceeds a certain value are required to be stabilized by interconnecting adjacent structural members with stiffening or bracing members. The present invention includes a metal bridging member and a method for installing the bridging member between adjacent structural members.

Figure 1:
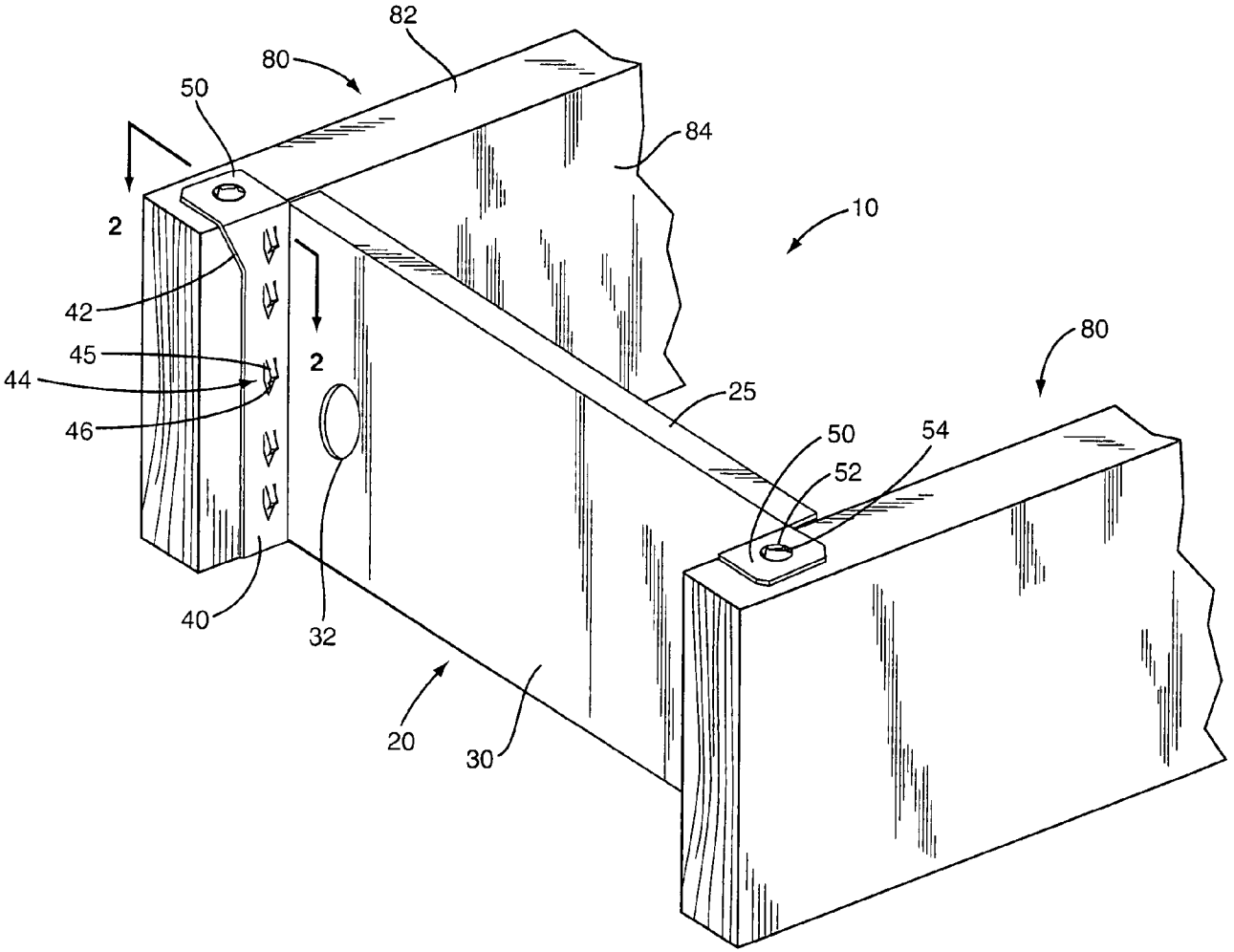
FIG. 1 is a perspective view of the bridging member engaged with and fastened between two structural members.
Figure 2:
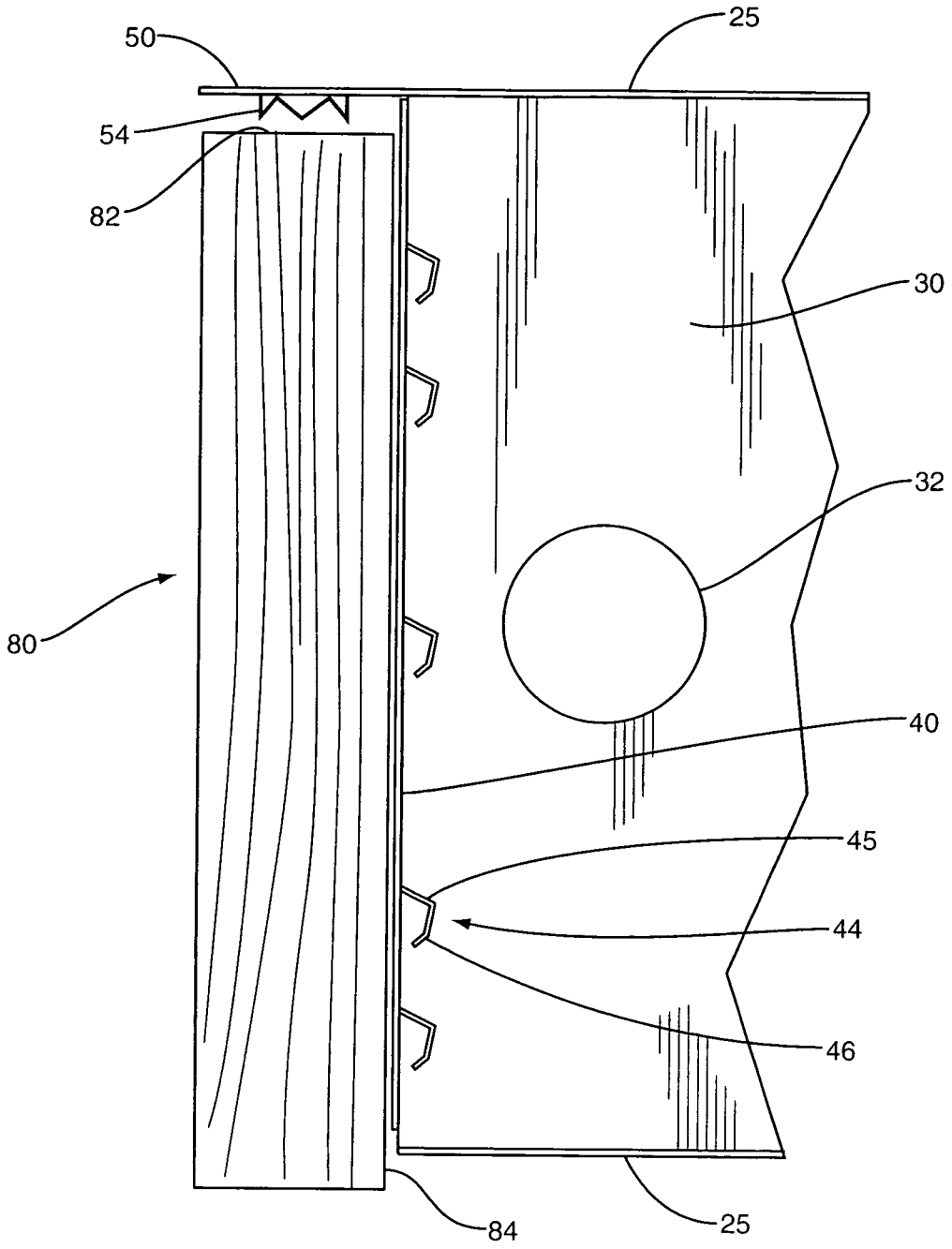
FIG. 2 is a sectional view of one end of a bridging member prior to being connected with a one structural member.
Figure 3:
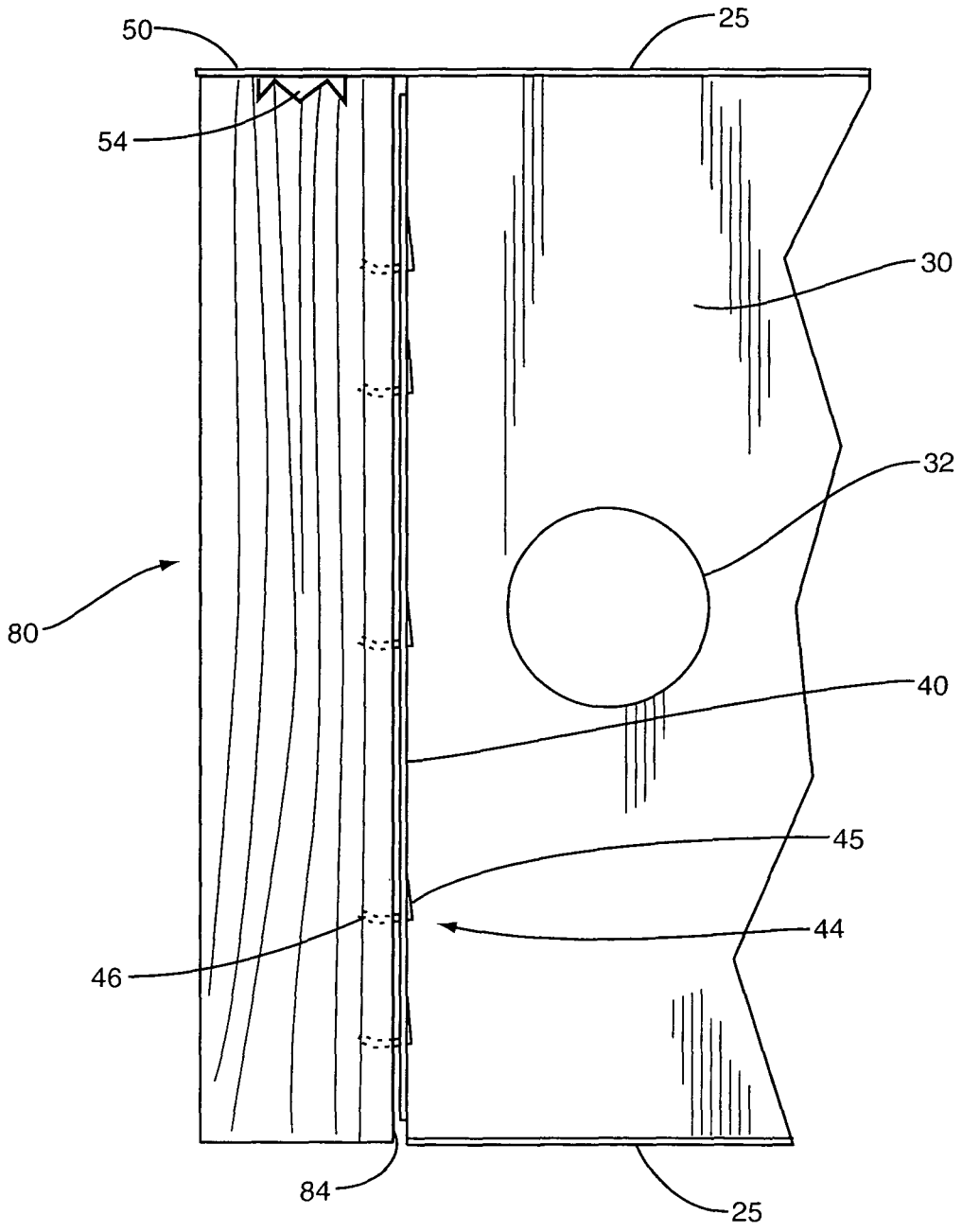
FIG. 3 is a sectional view of one end of a bridging member fastened to one structural member.

Turning now to the drawings, FIGS. 1-3 describe one particular embodiment of the invention. FIG. 1 shows in pictorial view a metallic bridging member and a frame structure, generally denoted by the numeral 10, in which a bridging member 20 is disposed adjacent to a structural member 80 which is typically made of wood, but could be made of other materials. Bridging member 20 includes two side flanges, 25, disposed along opposite sides of a web 30 and formed integrally with the web. Also formed within the web are one or more openings 32. Side flanges 25 are disposed generally perpendicularly to the web and opposite each other. The side flanges 25 give rise to stiffness in the bridging member to resist bending.

Bridging member 20 further includes two end flanges, 40, disposed generally perpendicularly to the web 30 and to the side flanges 25. Addressing more particularly one of the end flanges 40, included continuously therewith is an end tab 50 which generally lies perpendicular to the end flange 40 and to the web 30. Moreover, end tab 50 is a part or extension of an enlarged end portion 42 of the end flange 40. End tab 50 includes a hole 52 around the periphery of which are disposed a number of spikes 54 each generally perpendicular to the end tab and pointing in a direction such that the spikes engage the top 82 of the structural member 80. It is appreciated that the spikes 54 are formed integrally with the end tab 50.

Further considering one end flange, 40, included therein are a number of cleats 44 formed from the end flange. Each cleat 44 comprises a main body 45 which is angled generally towards the opposite end flange. Further, each cleat 44 includes a spike 46 formed into the end of the main body and angled back generally towards the end flange 40 from which the cleat 44 is formed.

Figure 4:
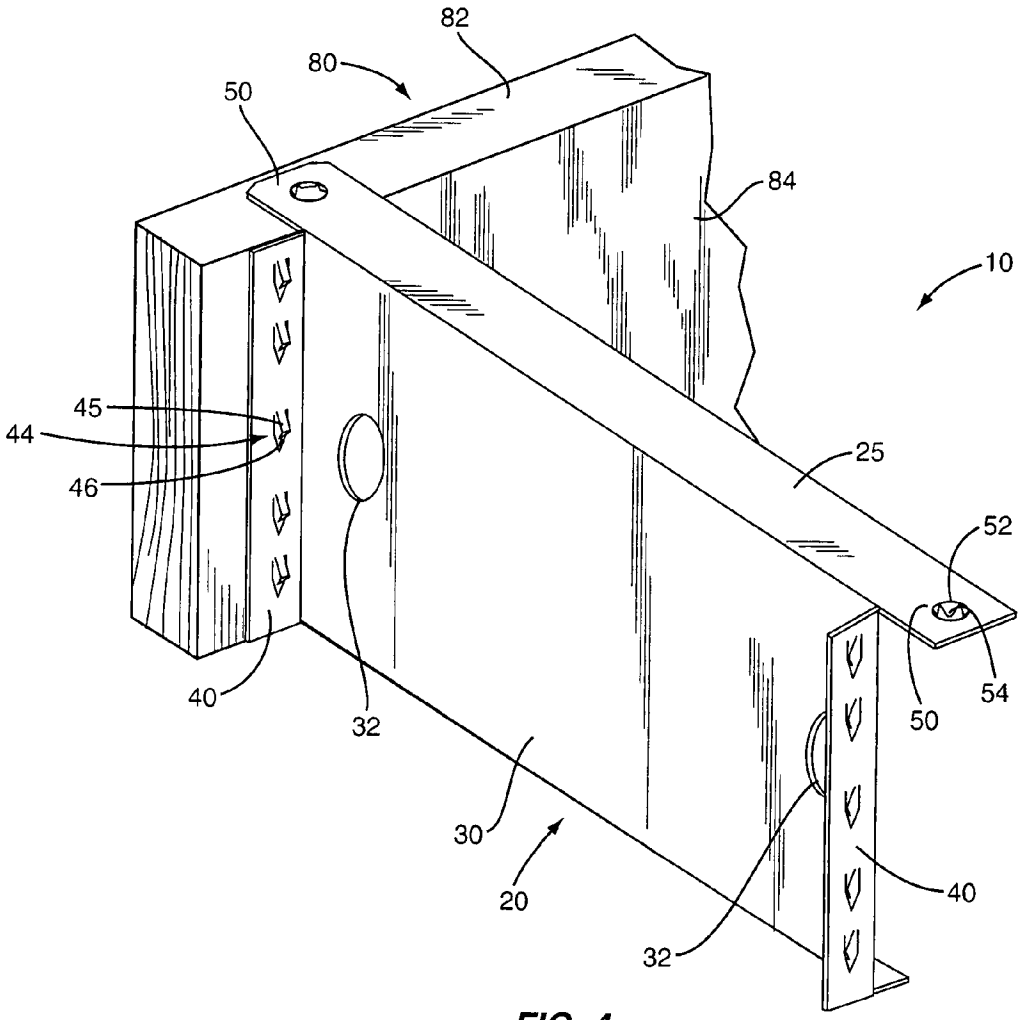
FIG. 4 is a perspective view of a second embodiment for the bridging member of the present invention.
Figure 4A:
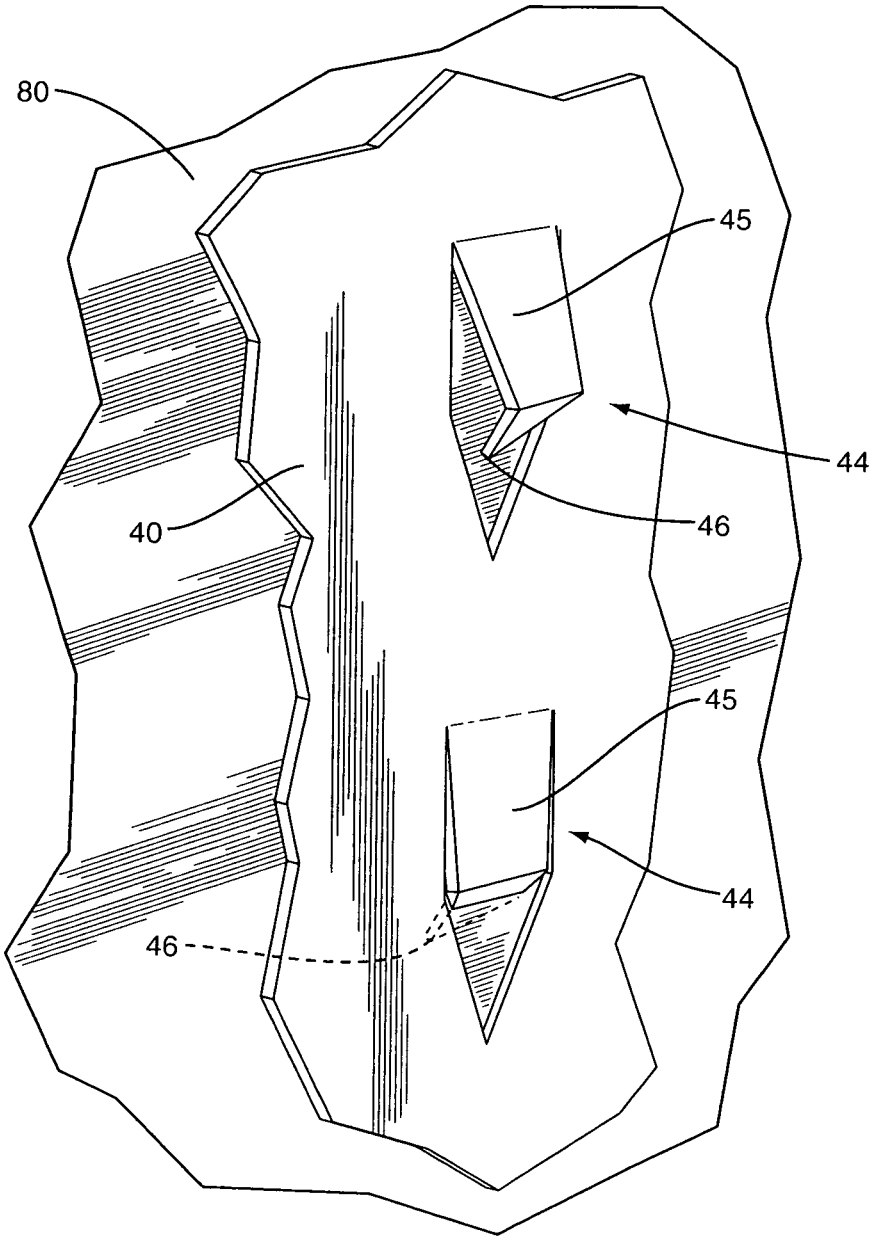
FIG. 4A is a view illustrating the cleat structure of the bridging member.

A second embodiment is shown in FIG. 4 wherein the foregoing description applies except as related to the end tabs 50. In this embodiment, the end tabs 50 are continuous with one side flange 25. It is appreciated that end tabs 50 are thus generally perpendicular to the web 30 and the end flange 40. Each end tab includes a hole 52 and spikes 54 as described in the first embodiment.

Turning now to the method of using the bridging member in construction and referring to FIGS. 2-4, the bridging member 20 is placed between adjacent structural members 80 such that the spikes 54 engage surface 82 of the structural member which lies generally perpendicular to opposing surfaces 84 of the structural member. Anchoring the bridging member 20 is accomplished by first driving the spikes 54 into surface 82 of the structural member. Anchoring the bridging member is completed by then driving each of the spikes 46 of the cleats 44 into the opposing surfaces 84 of the structural members. It is appreciated that anchorage can be further augmented by placing fasteners such a nails, bolts, or screws through the holes in the end tabs 50 and end flange 40.

After bridging members 20 are installed in a structure, certain utilities such as wiring or plumbing may be threaded through openings 32 in the webs 30 of the bridging members, allowing the utilities to be installed as needed.

When secured between the two structural members 80, the bridging member 20 forms a strong and rigid bridging structure that reinforces the frame structure that the two structural members 80 form a part of. Note that the end flanges 40 fit flush adjacent the opposing sides 84 of the two structural members 80 that are bridged. Furthermore, the end tabs 50 fit flush against the top or bottom edges 82 of the structural members 80. Extending between the end flanges 40 and end tabs 50 is the web 30 and the two side flanges 25. The structural rigidity offered by the web 30 and the two side flanges 25 form a strong interconnecting structure between the end flanges 40 and end tabs 50 and between the two structural members 80.

The present invention represents clear advantages over existing methods of reinforcing structural members by providing in one piece a complete bridging system which requires no cutting as with onsite prepared wooden "X" bridging and blocking, and no staged nailing as is required with cross bridging systems. As a result, likelihood of compliance with building codes by providing adequate bridging is improved while the process of accomplishing the required bridging is simplified.

By providing the cleats 44 and the spikes 54, the bridging member can be installed without utilizing mechanical fasteners such as nails, screws, bolts, etc. However, a fastener can be provided through the opening in the end tab 50 and openings can be provided in the end flanges 40 for receiving a mechanical fastener.

Figure 5:
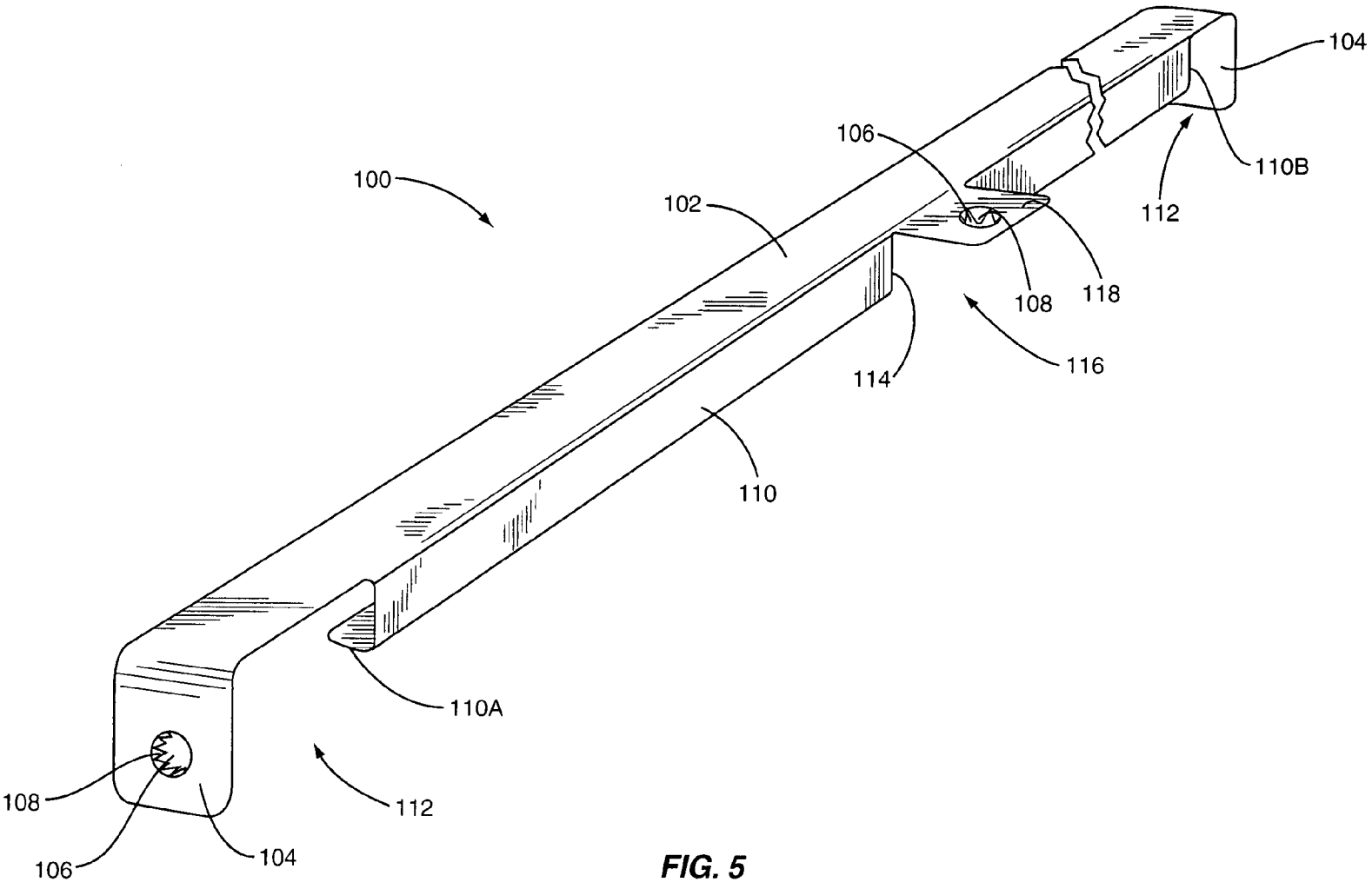
FIG. 5 is a perspective view of a second embodiment of the bridging member.
Figure 6:
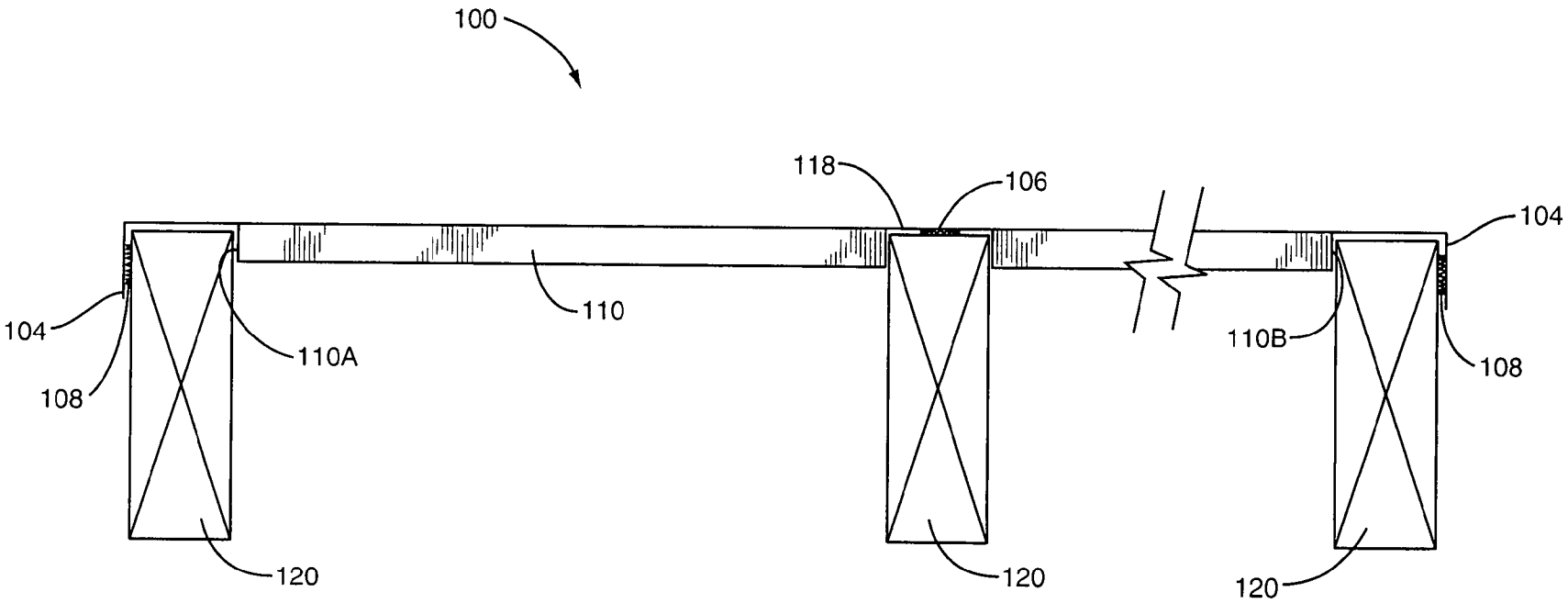
FIG. 6 is a top plan view showing the bridging member of FIG. 5 interconnecting a series of studs.

A second embodiment for the bridging member is shown in FIGS. 5 and 6. The bridging member of this embodiment is indicated generally by the numeral 100. With particular reference to FIGS. 5 and 6, the bridging member 100 comprises an elongated member that includes a main section 102 and a pair of opposed end portions 104. Main section 102 is generally straight and extends between the end portions 104. End portions 104 are angled generally perpendicular to the main section 102.

An opening 108 is formed in each end portion 104. A series of spikes 108 project inwardly from the opening 106 and are utilized to anchor the bridging member 100 to studs or structural members interconnected by the bridging member 100.

Extending from one edge or side of the main section 102 is a flange 110. Flange 110, in the case of the embodiment illustrated in FIGS. 5 and 6, assumes a generally L-shape. As seen in FIG. 5, the flange 110 and the main section 102 together form a channel-like configuration. Note that flange 110 does not extend the full length of the elongated member. More particularly, the ends of the flange, referred to by 110A and 110B, are indented or terminate inwardly from the end portions 104.

The arrangement of the flange 110 along with end portions 104 and main section 102 forms a pair of seats, indicated generally by the numeral 112, on opposite ends of the bridging member 100. Seats 112 are sometimes referred to as stud seats inasmuch as the seats are configured to receive a stud or structural member. In particular, the seat 112 shown on the left-hand side of the bridging member 100, as viewed in FIG. 5, is formed by the end portion 104, the end 110A of the flange 110 along with a portion of the main section 102 that extends between the end portion 104 and the flange end 110A.

Bridging member 110 can accommodate two spaced apart studs or structural members with the seats 112. Other stud or structural member seats can be formed in the bridging member 100. In this regard, a cutout 114 is formed in flange 110. This is particularly illustrated in FIG. 5. The cutout 114 forms another seat indicated generally by the numeral 116. As an option, the structural material cut from the flange 110 can be formed or disposed into a tab 118. Essentially in this embodiment, the material that forms the flange 110 in the area of the cutout is left to form the tab 118. In this case, the tab 118 will project from the flange 110 and generally lie in the same plane as the main section 110. It follows that when a stud or other structural member is seated within the seat 116 that the tab 118 will lie flush against or at least adjacent to a portion of the stud or structural member seated within seat 116. This is particularly illustrated in FIG. 6.

As illustrated in FIG. 6, a series of studs 120 are interconnected by the bridging member 100. Note that the two studs 120 disposed on extreme ends of the bridging member 110 are seated within seats 112, as viewed in FIG. 5. The spikes 108 that extend inwardly from the end portions 104 are driven into the sides of the studs 120. The intermediate stud or studs 120 are seated within the seats 116 that are formed in the flange 110. In the drawings illustrated in FIG. 5, only one intermediate seat 116 is shown. However, it should be noted that a plurality of intermediate seats 116 could be formed between the outer seats 112. Such other intermediate seats 116 could be formed in the same manner, that is, by forming a cutout in the flange 110. During the course of this disclosure, seats 112 and 116 have been described as being adapted or configured to receive studs. The term "studs" as used herein is meant to mean and encompass spaced apart structural members used in a building frame structure such as studs, floor joists, ceiling joists, rafters, etc.

Bridging member 100 can be utilized to interconnect a series of studs. It is contemplated that a series of bridging members 100 would be connected across a series of spaced apart studs. These bridging members 100 would be slightly offset such that the bridging members 100 would slightly overlap. That is, two bridging members would slightly overlap inasmuch as each would connect to one common stud.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A building frame structure comprising:

a. a first elongated structural member having a first longitudinal axis;

b. a second elongated structural member having a second longitudinal axis and being spaced apart from the first structural member, the first and second structural members extending generally parallel to each other such that the first and second longitudinal axes are parallel;

c. a bridging member interconnected between the first and second structural members, said bridging member including:

1) a central section consisting essentially of a web and a pair of side flanges extending from the web such that the side flanges and the web form a generally C-shaped configuration with an open side and a closed side, and wherein the open side faces in a first direction that is along the longitudinal axes;

2) a pair of end flanges, each extending generally perpendicularly from opposite ends of the web in a second direction opposite the first direction such that the end flanges engage opposing surfaces of the structural members;

3) a pair of end tabs, each extending from opposite ends of the bridging member such that when the bridging member is connected between the two structural members the end tabs engage surfaces of the structural members generally perpendicular to the opposing surfaces of the structural members; and d. wherein each end flange includes one or more cleats that project therefrom into one of the structural members.

2. A method of bridging two spaced apart elongated structural members that have parallel longitudinal axes and facing surfaces with a bridging member that includes a web, a pair of side flanges extending from opposite sides of the web in a first direction such that the web and the side flanges form a generally C-shaped section, a pair of end flanges extending generally perpendicularly from opposite ends of the web in a second direction opposite the first direction, and a pair of end tabs extending from opposite ends of the bridging member, the method comprising:

a. orienting the bridging member such that an open side of the generally C-shaped section faces in a direction of the longitudinal axes of the two structural members and placing the bridging member between the two structural members;

b. while the bridging member is so oriented, securing the end flanges of the bridging member to the facing surfaces of the two structural members;

c. connecting the end tabs of the bridging member to surfaces of the structural members that lie generally perpendicular to the facing surfaces of the two structural members; and d. wherein the end flanges include one or more cleats and the method further comprising driving the cleats into the facing surfaces of the structural members.

3. A method of bridging two spaced apart elongated structural members that have parallel longitudinal axes and facing surfaces with a bridging member that includes a web, a pair of side flanges extending from opposite sides of the web in a first direction such that the web and the side flanges form a generally C-shaped section, a pair of end flanges extending generally perpendicularly from opposite ends of the web in a second direction opposite the first direction, and a pair of end tabs extending from opposite ends of the bridging member, the method comprising:

a. orienting the bridging member such that an open side of the generally C-shaped section faces in a direction of the longitudinal axes of the two structural members and placing the bridging member between the two structural members;

b. while the bridging member is so oriented, securing the end flanges of the bridging member to the facing surfaces of the two structural members; and c. connecting the end tabs of the bridging member to surfaces of the structural members that lie generally perpendicular to the facing surfaces of the two structural members; and d. extending one or more utilities through an opening formed in the web.

* * * * *